US005145512A

United States Patent [19]

Spencer et al.

[11] Patent Number: 5,145,512

[45] Date of Patent: * Sep. 8, 1992

[54] TUNGSTEN NICKEL IRON ALLOYS

[75] Inventors: James R. Spencer, Sayre; James A. Mullendore, Towanda, both of Pa.

[73] Assignee: GTE Products Corporation, Stamford, Conn.

[ * ] Notice: The portion of the term of this patent subsequent to Jun. 7, 2005 has been disclaimed.

[21] Appl. No.: 293,031

[22] Filed: Jan. 3, 1989

[51] Int. Cl.[5] ..... C22C 27/04; B22F 3/24; B22F 3/16; C21D 8/06

[52] U.S. Cl. ..... 75/248; 419/28; 419/29; 419/47; 419/54; 419/55

[58] Field of Search ..... 419/28, 29, 47, 54, 419/55; 420/430; 75/248; 428/569

[56] References Cited

U.S. PATENT DOCUMENTS 4,749,410 6/1988 Mullendore et al. ..... 75/248

*Primary Examiner*—Brooks H. Hunt
*Assistant Examiner*—Daniel Jenkins
*Attorney, Agent, or Firm*—Elizabeth A. Levy

[57] ABSTRACT

A consolidated tungsten alloy body consisting essentially of from about 88% to about 98% by weight of tungsten, balance, nickel and iron, produced by liquid phase sintering, containing a continuous phase of a tungsten, nickel and iron alloy and a discontinuous phase of elongated grains of tungsten having an aspect ratio of at least 4:1 relatively uniformly distributed throughout the continuous phase and wherein said body has a recrystallization temperature of from about 1000° C. to about 1200° C. A process for producing the consolidated bodies comprises working and annealing at controlled temperatures to achieve the desired properties. The working temperatures are from about 700° C. to about 900° C. and the annealing temperature is preferably 1200° C.

11 Claims, No Drawings

TUNGSTEN NICKEL IRON ALLOYS

FIELD OF THE INVENTION

This invention relates to tungsten heavy alloys. More particularly it relates to tungsten heavy alloys with improved properties and a process for achieving same.

BACKGROUND

The composition of tungsten heavy alloys are known in the art and preferably have a tungsten content of from about 88% to about 98% by weight, balance nickel and iron. In conventional prior processes used to produce the preferred tungsten heavy alloys resulted in materials having spherical tungsten grains of at least 30 micrometers in diameter as a discontinuous phase and surrounded by a continuous matrix phase of nickel, iron and tungsten. When tungsten heavy alloys are used as kinetic energy penetrators they are generally mechanically worked to increase the hardness of the penetrator. With conventional working methods the reduction in area is generally in the 7% to 25% range. Working beyond 25% resulted in the generation of defects at the matrix tungsten interface.

It is believed, therefore, that a tungsten heavy alloy material containing from about 88% to about 98% tungsten and having improved properties, in particular, a higher recrystallization temperature, that is above about 1000° C., a discontinuous phase of tungsten grains with an aspect ratio greater than about 4:1 relatively uniformly dispersed thoughout the continuous tungsten-nickel-iron alloy phase and wherein the nickel to iron weight ratio in the tungsten heavy alloy is from about 6:4 to about 9:1, which alloy has a high impact strength and improved machinability would be an advancement in the art.

SUMMARY OF THE INVENTION

In accordance with one aspect of this invention there is provided a relatively ductile consolidated tungsten heavy alloy body consisting essentially of from about 88% to about 98% by weight of tungsten, balance nickel and iron in a weight ratio of from about 6:4 to about 9:1 containing a continuous tungsten, nickel and iron alloy phase and a discontinuous phase of elongated grains of tungsten having an aspect ratio of at least 4:1 relatively uniformly distributed throughout the continuous phase and wherein the body has a recrystallization temperature of from about 1000° C. to about 1200° C.

In accordance with another aspect of this invention, there is provided a process for producing consolidated bodies having a recrystallization temperature of from about 1000° C. to about 1200° C. which process comprises forming a bar of a tungsten heavy alloy consisting essentially of from about 88% to about 98% by weight of tungsten, balance nickel and iron by liquid phase sintering thereafter working the bar to achieve a total reduction of about 20% by using a series of passes to achieve from about 5% to about 20% reduction in cross-sectional area per pass at a first temperature range of from about 700° C. to about 900° C., annealing the reduced bar at a second temperature of from about 1200° C. to about 1400° C. for at least about 2 hours, working the annealed bar at the first temperature range using a series of passes to achieve from about 5% to about 20% reduction per pass to achieve about an additional 30% reduction in cross-sectional area and optionally repeating steps c and d until at least an 80% reduction is achieved. Thereafter, the material is treated by either heat treating or annealing, working and age hardening to achieve the desired ductility.

DETAILED DESCRIPTION OF THE PREFERRED EMBODIMENTS

For a better understanding of the present invention, together with other and further objects, advantages, and capabilities thereof, reference is made to the following disclosure and appended claims in connection with the above described description of some of the aspects of the invention.

Tungsten heavy alloys are normally produced by liquid phase sintering and have tungsten grains of about 30 micrometers in size uniformly distributed throughout a matrix of an alloy of tungsten-nickel-iron.

To produce grains of a high aspect ratio, which is believed to promote penetration performance of kinetic penetrators, tandem rolling with a Kocks mill or hydrostatic extrusion can be used. Such methods can enable over 80% reductions and aspects ratios of over about 4. Although tandem rolling with a Kocks mill or hydrostatic extrusion can be used to achieve 80% reductions in area, these methods lower the recrystallization temperatures of the tungsten grains to as low as 800° C. and recrystallization of these grains causes a dramatic loss in mechanical properties. Being limited to below 800° C. severely restricts the heat treatments that can be used to recover ductility in the matrix phase of the tungsten heavy alloys. Ductility is an important property in penetrators.

In the practice of this invention the tungsten heavy alloy bars, formed by liquid phase sintering, are worked by rolling or swaging at a first temperature range of from about 700° C. to about 900° C. with intermediate anneals at a second temperature range of from about 1200° C. to about 1400° C. Working below about 700° C. at the first temperature range results in age hardening effects when reheated. Working at above about 900° C. at the first temperature range results in the development of defects at the tungsten matrix interface.

The bars are worked using passes to achieve from about 1 to about 20% reduction in cross sectional area per pass. Since there is no need to use less than about 5% reduction per pass, it is perferred to use from about 5 to about 20% reduction per pass. During the annealing step a vacuum or a nitrogen atmosphere is used. After working the first 20% bars are given a 2 to 3 hour anneal at about 1200° C. to about 1400° C. and then are worked an additional 30% using 5% to about 20% reduction per pass. This anneal and reduction sequence can be repeated as many times as required to reach the desired diameter. Preferably a reduction of at least about 80% is achieved. Once at the desired size, the bar can be heat treated at a temperature of from about 700° C. to about 1200° C. for about 2 to about 4 hours to develop the desired ductility in the matrix. Alternatively, the bar can be annealed again at 1200° C. and then worked at 20° C. to 300° C. to 7% to about a 25% reduction in area. The bars can then be hardened to the desired level by aging them at temperatures of 400° C. to 600° C. for at least about 2 hours.

The microstructure of the alloys shows that there is a continuous phase of a tungsten-nickel-iron alloy and discontinuous phase of elongated grains of tungsten. The aspect ratio of the grains of tungsten is at least 4:1 with many grains having an aspect ratio of as high as 30:1.

The alloys of this invention are relatively ductile, that is the ductility of the alloys of this invention is equal to or exceeds the ductility of the prior art alloys which had generally spherical tungsten grains of at least about 30 micrometers surrounded by a continuous phase of tungsten, nickel and iron.

The alloys thus produced have unique characteristics in that they have a recrystallization temperature of from about 1000° C. to about 1200° C. and have a discontinuous phase of of elongated tungsten grains having an aspect ratio of at least about 4:1 and a thickness of less than about 3 micrometers, as measured in the transverse plane, and a continuous phase of an alloy of tungsten, nickel and iron wherein the nickel and iron are in a weight ratio of from about 6:4 to about 9:1, with from about 7:3 to about 8:2 being preferred. The tungsten content of the alloys range from about 88% to about 98% by weight of tungsten, with from about 90% to about 96% being preferred.

While there has been shown and described what are considered the preferred embodiments of the invention, it will be obvious to those skilled in the art that various changes and modifications may be made therein without departing from the scope of the invention as defined by the appended claims.

What is claimed:

1. A relatively ductile consolidated tungsten heavy alloy body consisting essentially of from about 88% to about 98% by weight of tungsten, balance nickel and iron in a weight ratio of from about 6:4 to about 9:1 containing a continuous tungsten, nickel and iron alloy phase and a discontinuous phase of elongated grains of tungsten having an aspect ratio of at least 4:1 relatively uniformly distributed throughout the continuous phase and wherein the body has a recrystallization temperature of from about 1000° C. to about 1200° C.

2. A body according to claim 1 wherein said body contains from about 88% to about 98% by weight of tungsten.

3. A body according to claim 1 wherein said body has a nickel to iron ratio of from about 7:3 to about 8:2.

4. A process for producing consolidated bodies having a recrystallization temperature of from about 1000° C. to about 1200° C. which process comprises a) forming a bar of a tungsten heavy alloy consisting essentially of from about 88% to about 98% by weight of tungsten, balance nickel and iron by liquid phase sintering;

b) working the bar to achieve a total reduction of about 20% by using a series of passes to achieve from about 1% to about 20% reduction in cross-sectional area per pass at a first temperature range of from about 700° C. to about 900° C.;

c) annealing the reduced bar at a second temperature of from about 1200° C. to about 1400° C. for at least about 2 hours; and d) working the annealed bar at the first temperature range using a series of passes to achieve from about 5% to about 20% reduction per pass to achieve about an additional 30% reduction in cross-sectional area e) repeating steps (c) and (d) in sequence as necessary to achieve a desired reduction and f) heat treating the resulting reduced diameter bar at a temperature of from about 700° C. to about 1200° C. for at least about 2 hours.

5. A process according to claim 4 wherein steps c and d are repeated until at least an 80% reduction in cross-sectional area is achieved.

6. A process according to claim 4 wherein the tungsten content is from about 90% to about 96% by weight.

7. A process according to claim 4 wherein in step b a reduction of from about 5 to about 20% is utilized.

8. A process for producing consolidated tungsten heavy alloy bodies which process comprises:

a) forming a bar of a tungsten heavy alloy consisting essentially of from about 88% to about 98% by weight of tungsten, balance nickel and iron in a weight ratio of nickel to iron of from about 6:4 to about 9:1, by sintering at a temperature above the melting point of at least one component of said alloy;

b) working the bar at a temperature of between about 700° C. and about 900° C. using a series of passes to achieve from about 1% to about 20% reduction in cross-sectional area per pass to produce an initially reduced bar having a reduction of about 20% in cross sectional area;

c) annealing the reduced bar at temperature of from about 1200° C. to about 1400° C. for at least about 2 hours;

d) working the annealed bar at about 700° C. to about 900° C. using a series of passes to achieve from about 5% to about 20% reduction per pass until about an additional 30% reduction in cross-sectional area is achieved;

e) repeating steps (e) and (f) in sequence as necessary to achieve a desired reduction;

f) annealing said desired diameter bar at a temperature of about 1200° C.;

g) working at about 200° C. to about 300° C. to about a 7% to about a 25% reduction in area, and h) age hardening at about 400° C. to about 600° C.

9. A process according to claim 8 wherein steps c and d are repeated until at least an 80% reduction in cross-sectional area is achieved.

10. A process according to claim 8 wherein the tungsten content in said alloy is from about 90% to about 96% by weight.

11. A process according to claim 8 wherein in step b reductions of from about 5 to about 20% are utilized.

* * * * *